US005390643A

United States Patent [19]

Sekine

[11] Patent Number: 5,390,643

[45] Date of Patent: Feb. 21, 1995

[54] PRESSURE CONTROL APPARATUS FOR FUEL TANK

[75] Inventor: Hidetoshi Sekine, Kiryu, Japan

[73] Assignee: Fuji Jukogyo Kabushiki Kaisha, Tokyo, Japan

[21] Appl. No.: 165,340

[22] Filed: Dec. 13, 1993

[30] Foreign Application Priority Data

Jan. 13, 1993 [JP] Japan ..... 5-003435[U]

[51] Int. Cl.[6] ..... F02M 37/00

[52] U.S. Cl. ..... 123/514

[58] Field of Search ..... 123/514, 516, 518, 520, 123/456, 525; 137/197, 199, 587

[56] References Cited

U.S. PATENT DOCUMENTS

| | | | |
|---|---|---|---|
| 4,279,232 | 7/1981 | Schuster et al. | 123/514 |
| 4,502,450 | 3/1985 | Duprez | 123/514 |
| 4,617,116 | 10/1986 | Seiler | 123/514 |
| 4,732,131 | 3/1988 | Hensel | 137/199 |
| 4,763,684 | 8/1988 | Kelch | 123/514 |
| 5,050,567 | 9/1991 | Suzuki | 123/514 |
| 5,146,901 | 9/1992 | Jones | 123/514 |
| 5,174,265 | 12/1992 | Sekine | 123/520 |
| 5,205,330 | 4/1993 | Sekine | 141/59 |
| 5,215,110 | 6/1993 | Benjay | 137/587 |
| 5,215,132 | 6/1993 | Kobayashi et al. | 123/518 |
| 5,269,276 | 12/1993 | Brown | 123/516 |

FOREIGN PATENT DOCUMENTS 222855 10/1991 Japan .

*Primary Examiner*—Willis R. Wolfe
*Assistant Examiner*—Thomas N. Moulis
*Attorney, Agent, or Firm*—Beveridge, DeGrandi, Weilacher & Young

[57] ABSTRACT

A pressure reducing valve with a breathing hole is incorporated in a dome provided on the upper wall of a fuel tank and it is open to a vent pipe. A fuel cut valve with a leak hole is provided proximately to the pressure reducing valve. Opening-closing means are also provided on the port side of the fuel cut valve so as to actuate both the pressure reducing valve and the fuel cut valve. When an engine is running, the pressure of return fuel is applied to a float of the opening-closing means, whereby the pressure reducing valve is opened and the fuel cut valve is closed. When the engine is stationary, due to no pressure of return fuel, the float goes down to close the pressure reducing valve and open the fuel cut valve.

13 Claims, 2 Drawing Sheets

1
2
2a
2b
3
4
5
6
7
8
9
10
11
12
20
21
21a
21b
21c
22d
22
22a
22b
22c
23
23a
23b
23c
A
B
C
D

PRESSURE CONTROL APPARATUS FOR FUEL TANK

BACKGROUND OF THE INVENTION

The present invention relates to a pressure control apparatus for the fuel tank of the motor vehicle and more particularly to a pressure control apparatus for controlling the pressure of gases within the fuel tank during an engine operation.

Emission control standards for vehicle fuel systems have been in force for these years and a conventional production motor vehicle now has an evaporative emission control system that includes a vapor storage canister. The vapor storage canister stores fuel vapors generated in the fuel tank and discharges fuel vapors to the induction system of the engine so as to make those vapors burned together with mixture gases in the combustion chamber of the engine. In the near future, the emission control standards are going to be tightened such that evaporative emissions are restricted during broader operational conditions including a normal running. Particularly, the tightened emission standards contain a rule that the pressure in the fuel tank should be restricted to be controlled below a specified value through a greater part of vehicle running conditions.

To meet these requirements of the rule, some countermeasures for reducing the pressure within the fuel tank during a vehicle running are needed. There have been proposed several techniques for controlling the pressure within the fuel tank to date. For example, Japanese application Laid open No. 1991-222855 discloses a technique for controlling the pressure within the fuel tank especially after an engine stop. In this prior art, a breather line for delivering a fuel vapor runs from the fuel tank to the canister and in parallel with the breather line a by-pass line is provided on the way of the breather line. A check valve is disposed on the breather line and on the other hand a solenoid valve is provided on the by-pass line. The solenoid valve is designed to be opened or closed by a timer. During an engine stop, the solenoid valve is opened for a predetermined time in order to relieve the pressure in the recess occupied above the fuel level.

However, in this prior art the pressure during an engine operation is restricted by the check valve so that the pressure within the fuel tank is not reduced to a level below the one determined by the check valve while an engine is running.

SUMMARY OF THE INVENTION

In view of the foregoing, it is an object of the present invention to provide a pressure control apparatus for the fuel tank capable of always discharging a fuel vapor and reducing the pressure within the fuel tank in any operating conditions including a vehicle running.

In order to achieve the above object the pressure control apparatus according to the present invention is characterized in:

a pressure reducing valve opened responsive to an existence of the return fuel and closed responsive to a nonexistence of the return fuel for admitting the fuel vapor to flow out of the fuel tank and for controlling the pressure within the fuel tank; a fuel cut valve closed responsive to an existence of the return fuel and opened responsive to a nonexistence of the return fuel for separating the fuel vapor from the fuel; and opening-closing means responsive to an existence of the return fuel for actuating both of the pressure reducing valve and the fuel cut valve so as to open the pressure reducing valve and to close the fuel cut valve.

Next, based on the composition of means abovementioned, it will be briefly explained how the pressure control apparatus for the fuel tank according to the present invention functions:

While the engine is in operation, the fuel in the fuel tank is delivered to the engine by the pressure generated in the fuel pump and consumed in the engine. However, the fuel is partially returned to the fuel tank through the pressure regulator. The opening-closing means provided in the fuel return line opens the pressure reducing valve and at the same time to close the fuel cut valve by the pressure of the return fuel. Thus, the fuel vapor is separated from the fuel and then it is flowed out of the fuel tank to the canister through the pressure reducing valve, whereby the pressure within the fuel tank is reduced to a substantially low level.

On the other hand, while the engine is stationary, the fuel pump is inoperative, so there is no return fuel for moving the opening-closing means. Consequently, the opening-closing means, on the contrary, close the pressure reducing valve and open the fuel cut valve, whereby the fuel vapor is slowly discharged from the fuel tank through the small leak hole provided in the valve body of the pressure reducing valve.

DESCRIPTION OF THE PREFERRED EMBODIMENTS

Figure 1:
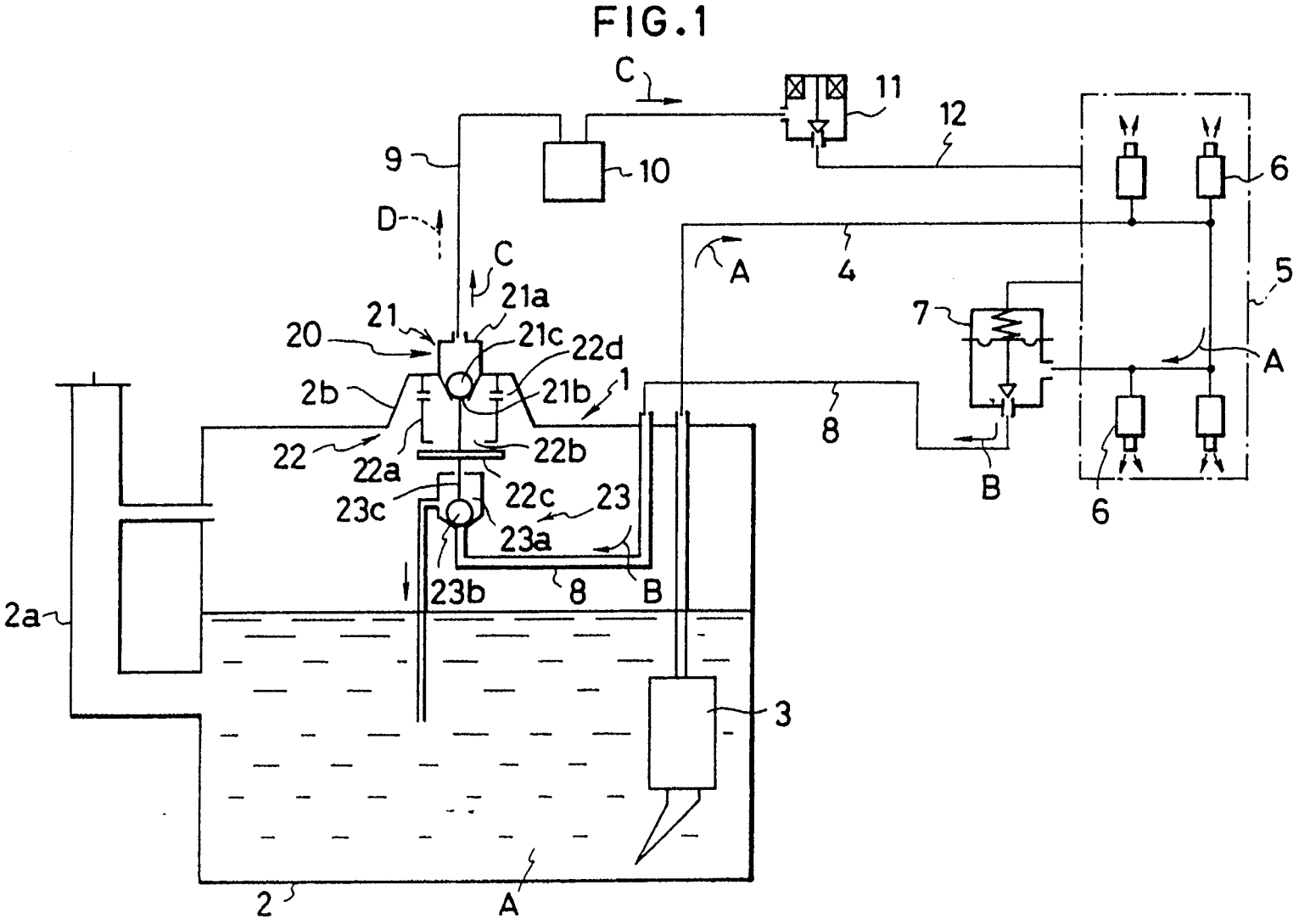
FIG. 1 is a schematic view showing the pressure control apparatus according to the present invention.

FIG. 1 illustrates an overview showing a fuel system of a fuel injection engine in which numeral 1 denotes a fuel system according to the present invention. In FIG. 1 a fuel tank 2 for storing a fuel A is mounted on a motor vehicle (not shown) and a filler pipe *2a* is equipped with the fuel tank 2 for replenishing the fuel A therethrough. A high volume type fuel pump 3 is incorporated at the bottom of the fuel tank 2. In a recess beneath the upper wall of the fuel tank 2 a pressure control apparatus 20 is disposed. The fuel pump 3 is driven by an electric motor (not shown) upon an engine start and it discharges the fuel A stored in the fuel tank 2. A delivery pipe 4 runs from the fuel tank 3 to an engine 5. The fuel A is delivered through the delivery pipe 4 to a pressure regulator 7 where the fuel pressure is regulated so that the pressure difference between the fuel system and the induction system is constant. A return fuel B overflowed from the regulator 7 still has a pressure level that can be utilized for the pressure control in the fuel tank 2. A fuel return pipe 8 is connected to a pressure control apparatus 20. On the other hand, a dome *2b* is formed on the upper wall of the fuel tank 2 and the pressure control apparatus 20 is mounted beneath the upper wall of the dome *2b*. A vent pipe 9 runs from the top of the pressure control apparatus 20 to an intake port of a canister 10 so as to introduce a fuel vapor C within the fuel tank 2 into the canister 10. Further a purge pipe 12 connects a discharge port of the canister 10 with the induction system of the engine 5 via a solenoid valve 11.

The pressure control apparatus 20 integrally comprises a pressure reducing valve 21, a fuel cut valve 22, opening-closing means 23 and a rod 23*c* coaxially coupling the pressure reducing valve 21, the fuel cut valve 22 and the opening-closing means 23 in this order. The vent pipe 9 is connected with the pressure reducing valve 21.

The pressure reducing valve 21 has a valve housing 21*a* in which a ball-shaped valve body 21*c* is inserted so as to open or close a valve port 21*b* formed in a tapered-shape at the lower portion of the valve housing 21*a*. Further the valve body 21*c* has a breathing hole 24 with a small diameter nearby at the center of the valve body 21*c*. The breathing hole 24 serves as breathing between the fuel tank 2 and the vent pipe 9 when the valve body 21*c* closes the valve port 21*b*.

Figure 2:
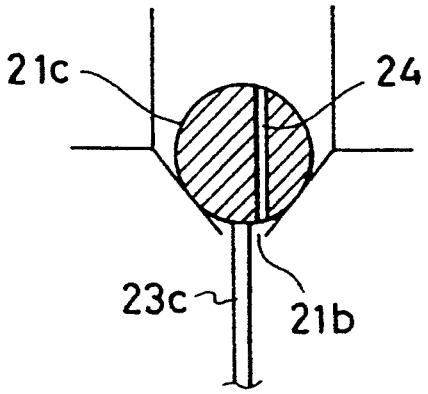
FIG. 2 is an expanded cross-sectional view of the pressure reducing valve for showing a leak hole thereof according to the present invention.

The fuel cut valve 22 is disposed just down the valve port 21*b* of the pressure reducing valve 21 with its valve housing 22*a* communicated with the valve port 21*b* of the pressure reducing valve 21 and a valve port 22*b* of a large diameter is designed at the bottom of the valve housing 22*a* so as to be opened or closed by a valve body 22*c* of a large diameter. Further, as shown in FIG. 2, a leak hole 22*d* is furnished with the valve housing 22*a* so that the fuel tank 2 communicates with the vent pipe 9 even when the fuel cut valve 22 is in a closed position.

The opening-closing means 23 has a float chamber 23*a* in which a float 23*b* is disposed so as to be floated by the pressure of the return fuel B from the pressure regulator 7. The float 23*b* is connected with both valve bodies 21*c* and 22*c* of the pressure reducing valve 21 and the fuel cut valve 22 respectively through a rod 23*c*. Because of this composition, when the float 23*b* is floated, the pressure reducing valve 21 is opened and the fuel cut valve 22 is closed via the rod 23*c*. On the other hand, when the float 23*b* goes down, the pressure reducing valve 21 is closed and the fuel cut valve 22 is opened.

Next, it will be explained how this preferred embodiment according to the present invention functions.

Figure 3:
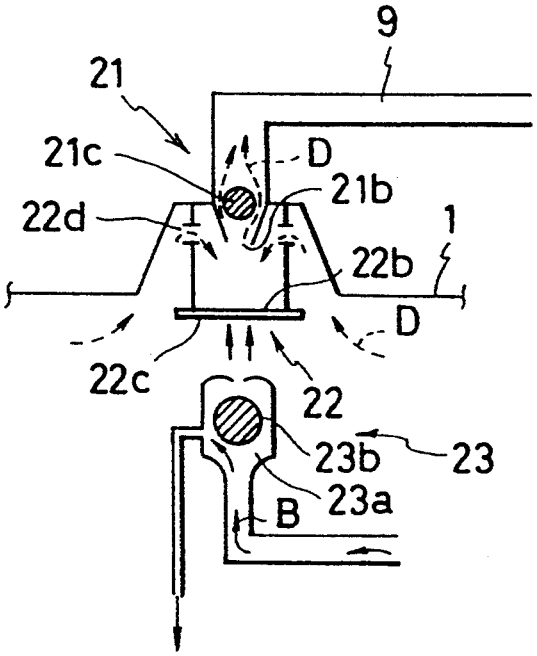
FIG. 3 is a schematic view showing the operation of the opening-closing means while an engine is running according to the present invention.

When the engine is running, the fuel pump 3 is driven to discharge a large amount of the fuel A from the fuel tank 2. The fuel A is conducted to the pressure regulator 7 through the delivery pipe 4 and it is delivered to the engine 5 after its pressure is regulated by the pressure regulator 7. The rest of the pressure-regulated fuel, namely the return fuel B is discharged towards the fuel tank 2 from the pressure regulator 7 with a certain pressure level and then it is introduced into the float chamber 23*a* of the opening-closing means 23 in the fuel tank 2 via the fuel return pipe 8. Then, as illustrated in FIG. 3, the float 23*b* is lifted up by the pressure of the return fuel B in the float chamber 23*a*, whereby the valve body 21*c* of the pressure reducing valve 21 going up to open the valve port 21*b* for discharging the fuel vapor C out of the fuel tank 2 and also the valve body 22*c* of the fuel cut valve 22 going up to close the valve port 22*b* for preventing the fuel A from flowing out of the fuel tank 2 while the engine is running.

As a result of this, when the engine is in operation, the fuel vapor C generated in the fuel tank 2 is discharged and the pressure within the fuel tank 2 is always kept low (normally at an atmospheric pressure level). The fuel vapor C flows into the canister 10 through the vent pipe 9 and stored therein. Then, therefrom it is sucked into the engine 5 by intake vacuum of engine through the purge pipe 12 when the solenoid valve 11 is opened under a specified operational condition of engine.

On the other hand, when the engine is stationary, since the fuel pump 3 is stopped, the return fuel B ceases to lift up the float 23*b*. Resultantly, the pressure reducing valve 21 is closed and the fuel cut valve is opened as shown in FIG. 1. The fuel vapor generated during an engine stop gradually is flowed out of the fuel tank 2 through the breathing hole 24 of the valve body 21*c*.

It will be understood that the preferred embodiment according to the present invention is not intended to be limited to the preferred embodiment described above.

In an example, the fuel cut valve 22 may be displaced with a fuel separator having no such an opening or closing valve as in the preferred embodiment according to the present invention. In this case the fuel separator may be any type of fuel separator ordinarily in use but it will be necessary that the fuel separator is coupled with the pressure reducing valve 21. The typical feature of this composition will be such that the valve body 22*c* and the valve port 22*b* are removed and the bottom of the valve housing 22*a* is enclosed with a wall having a through hole for the rod 23*c*.

Also, the opening-closing means 23 making use of the pressure of the return fuel may be displaced with a solenoid actuator that actuates the rod 23*c* upon energizing the fuel pump 3.

Further the present invention relates to the pressure control apparatus for the fuel tank of the automobile vehicle, however it can be applied to a fuel system for others than automobile vehicles.

While the presently preferred embodiment of the present invention has been shown and described, it is to be understood that this disclosure is for the purpose of illustration and that various changes and modifications may be made without departing from the scope of the invention as set forth in the appended claims.

It is claimed:

1. A pressure control apparatus for a fuel tank, the fuel tank being in a fuel system, which fuel system includes the fuel tank for storing a fuel, a fuel pump, a fuel vapor storage device for storing a fuel vapor, a vent line for feeding said fuel vapor, a pressure regulator for regulating a fuel pressure, and a fuel return line for sending back a return fuel from said pressure regulator for regulating a fuel pressure, and a fuel return line for sending back a return fuel from said pressure regulator to said fuel tank, the apparatus comprising:

a first valve opened responsive to an existence of said return fuel and closed responsive to a nonexistence of said return fuel for admitting said fuel vapor to flow out of said fuel tank and for controlling the pressure within said fuel tank;

a second valve closed responsive to an existence of said return fuel and opened responsive to a nonexistence of said return fuel for separating said fuel vapor from said fuel; and opening-closing means responsive to an existence of said return fuel for actuating both of said first valve and said second valve so as to open said first valve and to close said second valve.

2. The apparatus according to claim 1, wherein said first valve is integrally formed with said second valve and with said opening-closing means and mounted on or beneath the upper wall of a dome provided on said fuel tank.

3. The apparatus according to claim 1, wherein said opening-closing means is disposed on said fuel return line within said fuel tank and comprises a float chamber, a float therein, and a rod fixed on said float, so as to open said first valve and close said second valve through said rod when said float is lifted up by the pressure of said return fuel.

4. The apparatus according to claim 3, wherein said rod is extended to a valve body of said first valve and a valve body of said second valve and links both.

5. The apparatus according to claim 1, wherein said first valve has a valve body with at least one hole for leaking out said fuel vapor therethrough.

6. The apparatus according to claim 1, wherein said second valve has a valve housing with at least one hole for leaking out said fuel vapor therethrough.

7. The apparatus according to claim 1 wherein said opening-closing means is a solenoid actuator responsive to an energization of said fuel pump.

8. A pressure control apparatus for a fuel tank, the fuel tank being in a fuel system, which fuel system includes the fuel tank for storing a fuel, a fuel pump, a vapor separator for separating a fuel vapor from said fuel, a fuel vapor storage device for storing said fuel vapor, a vent line for feeding said fuel vapor, a pressure regulator for regulating a fuel pressure, and a fuel return line for sending back a return fuel from said pressure regulator to said fuel tank, the apparatus comprising:

a valve opened responsive to an existence of said return fuel and closed responsive to a nonexistence of said return fuel for admitting said fuel vapor to flow out of said fuel tank and for controlling a pressure within said fuel tank; and opening-closing means responsive to an existence of said return fuel for actuating said valve so as to open said valve.

9. The apparatus according to claim 8, wherein said valve is integrally formed with said vapor separator and mounted on or beneath the upper wall of a dome provided on said fuel tank.

10. The apparatus according to claim 8, wherein said opening-closing means are disposed on said fuel return line within said fuel tank and comprises a float chamber, a float therein, and a rod fixed on said float, so as to open said valve by means of said rod when said float is lifted up by the pressure of said return fuel.

11. The apparatus according to claim 10, wherein said rod is extended to and connected with a valve body of said valve.

12. The apparatus according to claim 8, wherein said valve has a valve body with at least one hole for leaking out said fuel vapor therethrough.

13. The apparatus according to claim 7, wherein said opening-closing means is a solenoid actuator responsive to an energization of said fuel pump.

* * * * *